US008890693B2

(12) United States Patent
Yang

(10) Patent No.: US 8,890,693 B2
(45) Date of Patent: Nov. 18, 2014

(54) METHOD AND APPARATUS TO DEACTIVATE EAS MARKERS

(75) Inventor: Xiao Hui Yang, Saratoga, CA (US)

(73) Assignee: W G Security Products, Campbell, CA (US)

( * ) Notice: Subject to any disclaimer, the term of this patent is extended or adjusted under 35 U.S.C. 154(b) by 295 days.

(21) Appl. No.: 13/436,547

(22) Filed: Mar. 30, 2012

(65) Prior Publication Data

US 2013/0257619 A1 Oct. 3, 2013

(51) Int. Cl.
*G08B 13/14* (2006.01)

(52) U.S. Cl.
USPC ..... 340/572.3; 235/449; 343/742

(58) Field of Classification Search
CPC ..... G08B 13/2408; G08B 13/2411; G08B 13/2471; G08B 13/2474; G08B 13/2477; G06K 7/10336; H01Q 7/00
USPC ..... 340/572.1, 572.3, 572.5, 572.6, 551; 235/449, 450; 343/742, 867
See application file for complete search history.

(56) References Cited

U.S. PATENT DOCUMENTS

| | | | | |
|---|---|---|---|---|
| 4,510,489 | A * | 4/1985 | Anderson et al. | 340/572.1 |
| 5,142,292 | A | 8/1992 | Chang | |
| 5,341,125 | A | 8/1994 | Plonsky et al. | |
| 5,805,065 | A | 9/1998 | Schwarz et al. | |
| 5,867,101 | A | 2/1999 | Copeland et al. | |
| 5,917,412 | A | 6/1999 | Martin | |
| 6,084,514 | A * | 7/2000 | Kopp et al. | 340/572.3 |
| 6,084,515 | A | 7/2000 | Maitin et al. | |
| 6,396,455 | B1 | 5/2002 | Ely et al. | |
| 6,400,271 | B1 | 6/2002 | Davies, Jr. et al. | |
| 6,778,087 | B2 | 8/2004 | Belka et al. | |
| 7,068,172 | B2 | 6/2006 | Yang et al. | |
| 7,281,314 | B2 | 10/2007 | Hess et al. | |
| 7,286,053 | B1 | 10/2007 | Gudeman et al. | |
| 7,374,092 | B2 | 5/2008 | Acosta et al. | |
| 7,495,564 | B2 | 2/2009 | Harold et al. | |
| 2009/0212952 | A1 | 8/2009 | Yang | |
| 2010/0052910 | A1 | 3/2010 | Yang | |

* cited by examiner

*Primary Examiner* — Thomas Mullen
(74) *Attorney, Agent, or Firm* — Waters Law Group, PLLC; Robert R. Waters; Brian W. Foxworthy

(57) ABSTRACT

This invention relates to a method and apparatus for deactivating EAS markers. The device utilizes deactivating magnetic fields created by energizing electrical coils to deactivate electronic article surveillance markers. It consists of housing having an internal structure holding an electrical coil arrangement. The coil arrangement comprises two electrical coils that are arranged essentially coplanar, arranged side-by-side. A third electrical coil is arranged such that each of its windings wraps around both the first and said second electrical coils. Current flowing through the coils generates a composite deactivating magnetic field above the housing. This deactivating magnetic field allows deactivation of a tag swept in any orientation, and does not require the tag to come into physical contact with the deactivating device. Flush mounting conserves space, allowing for ease of merchandise movement over the counter. A distinctive sound indicates the presence and deactivation of the label.

20 Claims, 13 Drawing Sheets

METHOD AND APPARATUS TO DEACTIVATE EAS MARKERS

BACKGROUND OF THE INVENTION (a) Technical Field of the Invention

This invention relates generally to a method and apparatus for deactivating electronic article surveillance ("EAS") acousto-magnetic markers, such as labels and tags. The method and apparatus disclosed herein relate to utilizing magnetic fields created by energizing electrical coils to deactivate electronic article surveillance markers.

Deactivating devices are typically used at the checkout counter in retail stores. Some devices are positioned permanently underneath the counter surface near the register at a point of sale ("POS") where a store employee deactivates tags on merchandise that are being purchased by customers. Given their use in retail stores, there is a need for these devices to perform their function efficiently, and with minimum error. Most such deactivating devices use a coil arrangement through which current flows, thereby creating a deactivating magnetic field. The magnitude and shape of this deactivating magnetic field may be altered by factors such as changes in the strength of the current, the physical shape and composition of the coils, the number of windings used in each coil, the physical arrangement of the coils when multiple coils are used, the electrical connections between the coils, and the number of coils. It is not advisable to increase the current beyond a certain range because this may lead to excessive heat buildup. Since these devices are positioned at checkout counters, such a buildup of heat is undesirable. Increasing the number of electrical coils or the number of windings in each coil yields larger devices. Apart from being unduly costly, this is also undesirable because counter space is limited. At the same time, the deactivating magnetic field should be such that it is intense in a small area where deactivation of a tag is likely to be carried out, while reducing the negative effects of far-field magnetic strength. Similarly, it is desirable that the tags may be swiped in any orientation; that their presence within the magnetic field is sufficient to quickly trigger the sequence that leads to detection and deactivation. It is also desirable that the deactivating device is small and may be easily transported, and can be mounted at the cash register in such a way so that it offers a maximum effective area for deactivation of a tag, without interfering with other objects at the checkout counter.

(b) Description of the Relevant Art

In U.S. Pat. No. 6,778,087 for a "Dual Axis Magnetic Field EAS Device," Belka et al. disclose a deactivator consisting of a solenoid-type coil that provides a magnetic field in one direction and another coil that provides a magnetic field in a substantially perpendicular direction, so that the EAS markers that pass through the device are positioned generally in the plane defined by the first and second directions. The magnetic fields in the two directions may be applied sequentially or simultaneously. There is also a possibility to include a third coil to create a magnetic field in a third direction that is substantially perpendicular to the plane defined by the first and second directions. This device is largely to be used for library books, videotapes, and the like, where the EAS markers are "dual-status," i.e. they can be activated and deactivated. The device in Belka '087 works with EAS markers associated with compact discs and other optically-recorded media. Such "dual-status" markers may be activated and deactivated regardless of their orientation relative to the fields produced by the coils. The Belka device requires the markers to pass through the device, and is directed to "dual-status" markers. It is therefore different from the present invention, which is directed toward "single-status" markers, and the markers may be swiped over the device, and are detected and deactivated when swiped in any orientation.

U.S. Pat. No. 7,281,314 by Hess, et al. is for a "Method for Implementing an Antenna System." This invention creates a multi-directional magnetic field using a single antenna. It includes a first core which could be of a standard cylindrical or rectangular shape. The core could be either an air core or a ferrite core. The first coil is cylindrically or helically wrapped around the core and forms a first antenna. The second coil may be wound transversely around the ends of the core in the shape of a rectangle or an oval, and forms a second antenna. The windings of each coil are orthogonal to each other, and so the magnetic fields generated in each coil are also orthogonal to each other. A third coil may be included. This is wrapped transversely to the first coil and the second coil. The first, second and third coil may all be wound orthogonal to each other such that the respective magnetic field will be mutually orthogonal. These antennas are used in medical applications, including implants, and are not claimed to be useful in the deactivation of EAS markers to which the present invention is directed. Thus, the Hess patent is non-analogous art.

U.S. Pat. No. 6,396,455 by Ely, et al. is for an "Antenna with Reduced Magnetic Far Field for EAS Marker Activation and Deactivation." This invention is directed at the problem of limiting the far magnetic field. The device comprises of a rectangular core which, in some embodiments, is formed from powdered iron. A first coil is wrapped spirally about an axis of the core in a rotational direction; a second coil is wrapped spirally about the same axis of the core in a rotational direction counter to the first rotational direction; these two are combined to form a coil arrangement. Similarly, a third and fourth coil may be wrapped in like manner around the second axis of the core. These coil arrangements are then driven by a decaying alternating current to produce a decaying, alternating magnetic field for deactivation of EAS markers. The two coil arrangements here have independent current sources.

Another device to deactivate "dual-status" markers is disclosed in U.S. Pat. No. 5,341,125 by Plonsky, et al. for a "Deactivating Device for Deactivating EAS Dual Status Magnetic Tags." This device comprises a deactivator pad with a detection transmitting coil, a detection receiving coil, and a deactivating coil, all of which are in a substantially parallel or coplanar relationship. The detection transmitting coil is planar and of circular configuration. The deactivating coil could be inscribed within the detection transmitting coil or could circumscribe it. The detection receiving coil includes two adjacent planar coils that are parallel to the detection transmitting coil and the deactivation coil. The deactivating electromagnetic field has components in each of the three mutually orthogonal planes. The main object of this invention is to simultaneously detect and deactivate a tag.

U.S. Pat. No. 5,805,065 by Schwarz, et al. is for an "Electro-Magnetic Desensitizer". This invention relates to detection of the security marker and its deactivation. An electromagnetic coil is wrapped around a U-shaped yoke. The legs of the U-shaped yoke may fill the top of the coil to concentrate the magnetic field at the top of the coil. The entire apparatus may be mounted under the top of a cash register table so that the operator simply has to move an item with a tag across the table top to deactivate it.

U.S. Pat. No. 6,084,515 by Maitin, et al. is for a "Coil Array for EAS Marker Deactivator." The device consists of several substantially planar substrates stacked one on top of the other. Each planar substrate may be in the shape of a square, and consists of an array of spiral coils. All the coils in all the substrates are electrically connected together in series.

U.S. Pat. No. 5,142,292 by Chang, et al. is for a "Coplanar Multiple Loop Antenna for Electronic Article Surveillance Systems." The antenna includes a substantially planar dielectric substrate with conductive loops that are not coils, but are etched in the substrate, and are electrically connected in series. The entire device facilitates the deactivation of a tag oriented in any direction with respect to the antenna.

U.S. Pat. No. 5,917,412 by Martin is for a "Deactivator with Biplanar Deactivation." This device has two coil parts; the first one is positioned in angular adjacent relation to the second coil part, so that together they transmit a simultaneous deactivation field. Preferably, the first deactivating coil is positioned so that its plane is at an angle in the range of 45° to 135° with respect to the plane of the second deactivating coil. A similar device is disclosed in U.S. Pat. No. 7,374,092 by Acosta, et al. for a "Combined Data Reader and Electronic Article Surveillance (EAS) System." Here the deactivation modules may have various configurations such as planar coils, a magnetically active core with coil windings, or two part L-shape construction. The coils are housed in two separate units, one horizontal, and the second unit is placed at a suitable angle to the first unit. The two units may or may not be physically and/or electrically connected. U.S. Pat. No. 7,495,564 by Harold, et al. for "Systems and Methods for Data Reading and EAS Tag Sensing and Deactivating at Retail Checkout," discloses a device with one or more deactivating coils positioned in a variety of different angles and positions, depending on the shape of the deactivation zone desired to be formed. The deactivation unit itself comprises a central core of magnetically active material with outer wire windings through which current is passed to create the deactivating magnetic field. In U.S. Pat. No. 5,867,101 by Copeland, et al. for a "Multi-Phase Mode Multiple Coil Distance Deactivator for Magnetomechanical EAS Markers," the deactivating device consists of first, second, third and fourth rectangular coils arranged in a two-by-two array in a common plane. Two sets of coils are driven out of phase or in phase to achieve different magnetic fields. The coplanar coil arrangement can be adapted to the geometry of the checkout counter. For instance, one of the coils may be rotated out of the coplanar arrangement.

While the inventions mentioned above are mostly directed at various methods to deactivate tags or markers, they fail to achieve the advantages offered by the present invention. Many prior art devices for the deactivation of EAS markers require the tag to be swiped in a particular orientation or in a preferred direction. The shape and strength of the deactivating magnetic field in the prior art devices often requires the tag to be very close to the deactivator, or to physically touch the deactivating surface. These devices are often bulky and occupy a large portion of the counter space at the point of sale. Traditionally, deactivators or scanners must physically touch a label to deactivate it. But with the growing use of source tagging wherein the identification tags are hidden somewhere on an item or in its packaging, proximity deactivators or distance deactivators, or verifiers that don't require contact with a label, are becoming more important. The device of the present invention is a distance deactivator designed for flush mounting into the countertop, and the device improves throughput by quickly scanning and deactivating labels in all orientations. As a distance deactivator, the label need not come in contact with the deactivator; simply passing it over the deactivator is all that it takes. Since most EAS markers operate in the frequency range of 58,000 Hertz (58 Khz), this invention is designed to deactivate such markers.

High throughput, simplicity and a subtle presence are the main characteristics of this device. It is designed for flush mounting which conserves space, and allows for ease of merchandise movement over the counter. Simplicity means that there are no buttons to push and no lights to look at. A distinctive sound indicates the presence and deactivation of the label. High throughput means that the delays normally experienced by competitor products are easily avoided. This module interfaces the deactivator to the POS register, where the user can enable/disable the deactivation function right from the register.

SUMMARY OF THE INVENTION

The present invention preserves the advantages of the devices in the prior art, and improves upon them. This device is a very user-friendly tool. It allows for ease of merchandise movement over the counter.

The device itself is a distance deactivator designed for deactivating EAS markers. It consists of a housing having an internal structure holding an electrical coil arrangement. The housing has an electrical plug on its outer surface to connect to a source of electrical power. The coil arrangement itself comprises two electrical coils that are arranged essentially coplanar, arranged side-by-side. A third electrical coil is arranged such that each of its windings wraps around both the first and the second electrical coils. Current flowing through the coils generates a composite deactivating magnetic field above the housing. This deactivating magnetic field allows deactivation of a tag swept in any orientation. Another embodiment of the present invention features a distinctive sound that indicates the presence and deactivation of the label. This invention is therefore a substantial improvement over the devices of the prior art.

These and other features, variations and advantages which characterize this invention, will be apparent to those skilled in the art, from a reading of the following detailed description and a review of the associated drawings.

All features and advantages of this invention will be understood from the detailed descriptions provided. This description, however, is not meant to limit the embodiments, and merely serves the purpose of describing certain structural embodiments in detail.

BRIEF DESCRIPTION OF THE DRAWINGS

A better understanding of the present invention will be had upon reference to the following description in conjunction with the accompanying drawings, wherein.

DETAILED DESCRIPTION OF EMBODIMENTS

While the invention will be described in connection with certain embodiments, there is no intent to limit it to these embodiments. On the contrary, the intent is to cover all alternatives, modifications and equivalents as included within the spirit and scope of the invention. Various changes may be made to the function and arrangement of the elements described herein, without changing the scope of the invention being disclosed. It should be noted that the following description serves to teach at least one instance of how the various elements may be arranged to achieve the stated goals of this invention.

Figure 1A:
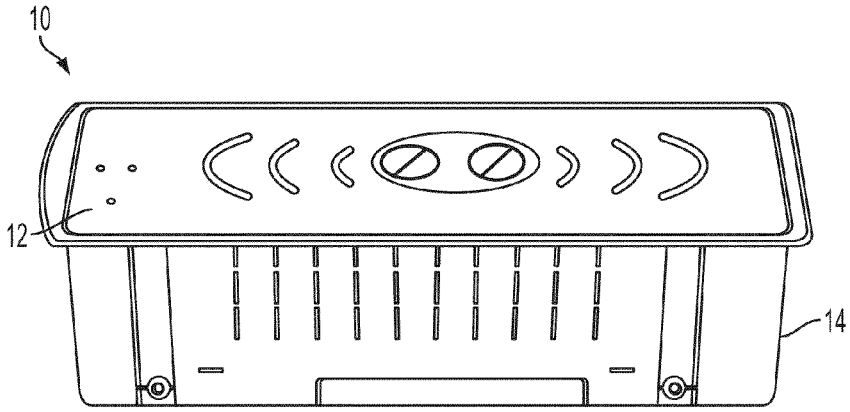
FIG. 1A is a perspective view of an embodiment of the deactivator showing the housing that contains the coil arrangement.

Referring now to the drawings, FIG. 1A is a perspective view of an embodiment of deactivator 10 showing housing 14. Housing 14 encloses the coil arrangement and, in some embodiments, a detecting system, such as a detecting antenna. The outer surface of housing 14 is shown to have three apertures 12, two for LEDs and one for sound.

Figure 1B:
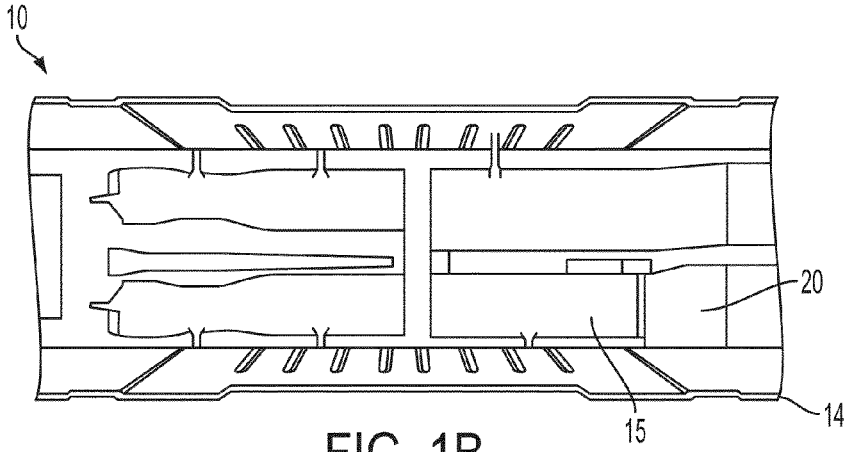
FIG. 1B is a top view of the interior of an embodiment of the deactivator showing the relative positions of the deactivating coil arrangement and the detecting antenna.

FIG. 1B shows the interior of housing 14 of an embodiment of deactivator 10. In this embodiment, the deactivating coil arrangement 20 is shown schematically at the bottom of housing 14. The detecting antenna 15 is positioned above deactivating coils 20 and just below the top surface of housing 14.

Figure 1C:
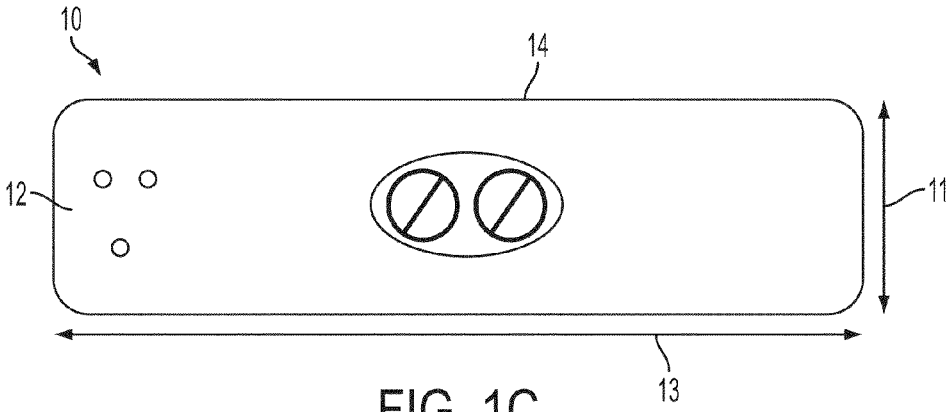
FIG. 1C is a top view of an embodiment of the deactivator illustrating the conventions for latitudinal and longitudinal directions.

Referring now to FIG. 1C, this drawing is a top view of an embodiment of the deactivator 10 illustrating the conventions for latitudinal direction 11 and longitudinal direction 13. These conventions are hereafter fixed for the remainder of this discussion.

Figure 2A:
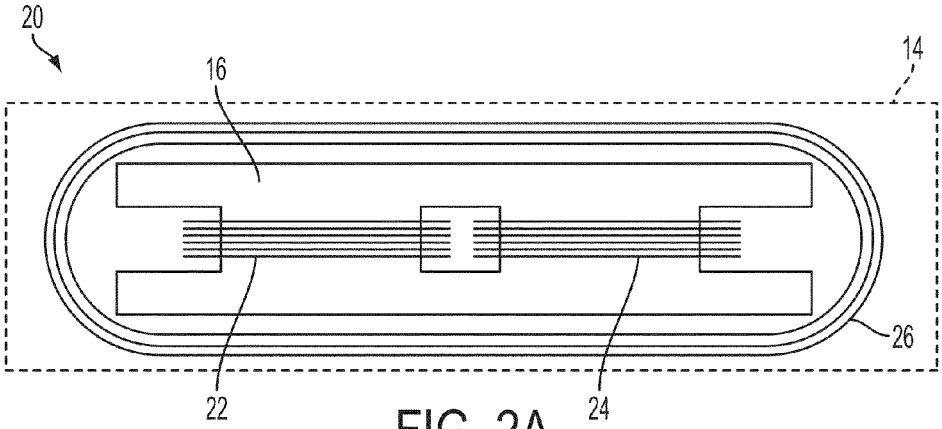
FIG. 2A is a side view of a housing interior showing generally the coil arrangement of a particular embodiment.

FIG. 2A demonstrates an embodiment of the invention, including a cross-sectional view of the coil arrangement 20 inside housing 14. It contains an internal structure 16 that holds coil arrangement 20. A vertical cross-section of internal structure 16 is shown. A first coil 22 is serially connected to a second coil 24. These two coils are coplanar and in near proximity to each other. In some embodiments, the two coils may have the same number of windings of the wire. The second coil 24 is then connected to a third coil 26. The third electrical coil 26 lies in a second plane intersecting the first plane containing first coil 22 and second coil 24, the common line of said first and second plane passing through the centers of first coil 22 and second coil 24. The third coil 26 circumscribes first coil 22 and second coil 24. The windings of this third coil 26 are wound around both the first coil 22 and the second coil 24 in the manner shown in FIG. 2A. Although this embodiment shows the two planes to be mutually perpendicular, other embodiments need not require such a restriction.

Referring still to FIG. 2A, a vertical cross-section of the internal structure 16 is shown. The first coil 22 and second coil 24 are arranged side by side and in close proximity to each other, along the longitudinal direction of deactivator 10. These two coils lie substantially in a plane parallel to the top and bottom surfaces of deactivator 10. The third coil 26 is shown to be wound around first coil 22 and second coil 24, in a longitudinal direction, such that each winding of third coil 26 is substantially parallel to the two longitudinal sides of deactivator 10.

Figure 2B:
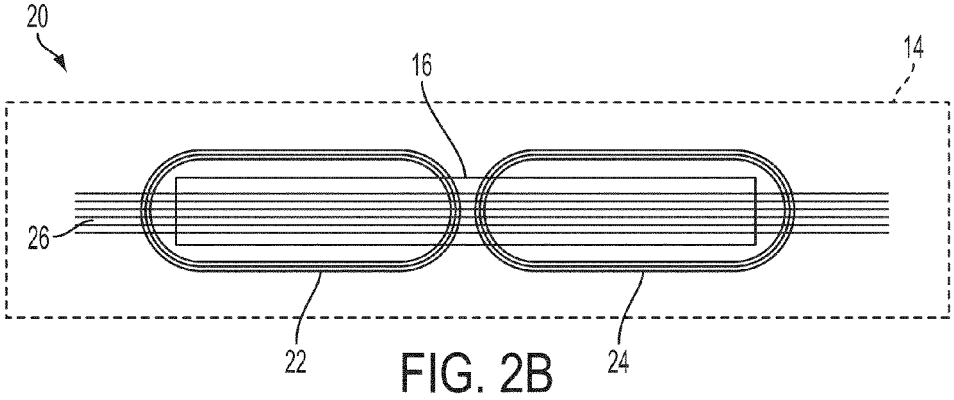
FIG. 2B is a top view of a housing interior showing generally the coil arrangement of a particular embodiment.

Referring now to FIG. 2B, which is a typical top view of coil arrangement 20 inside housing 14. It shows how a vertical cross-section of the internal structure 16 may hold the coil arrangement. The first coil 22 and second coil 24 are shown to be substantially planar and in near proximity to each other. The third coil 26 is wound longitudinally around both first coil 22 and second coil 24.

Figure 3:
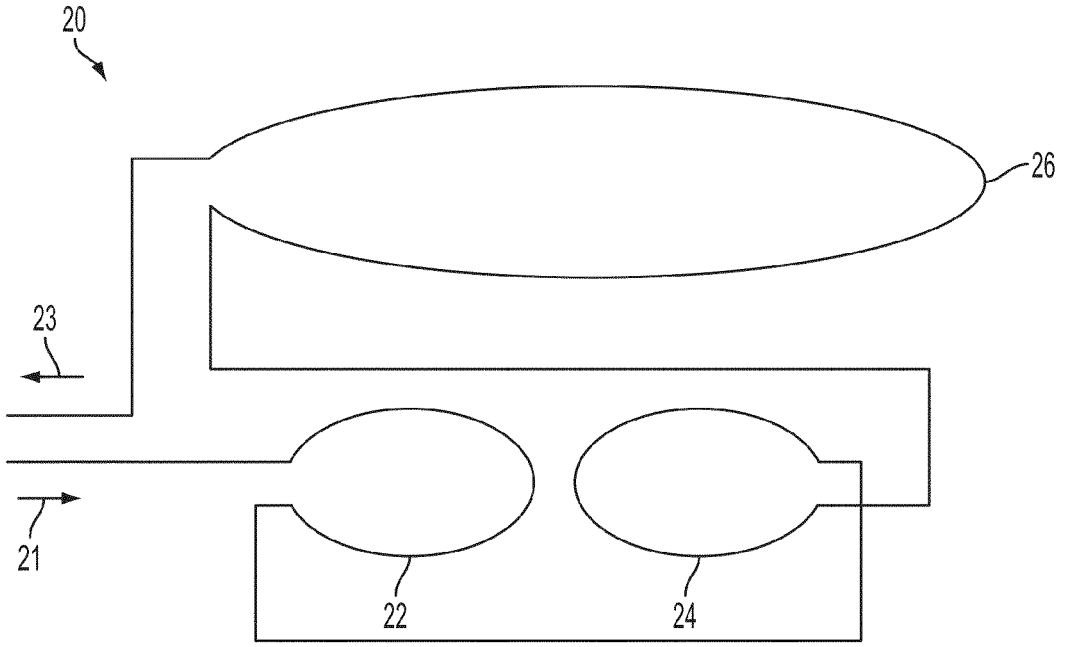
FIG. 3 is a schematic view of an embodiment of the flow and direction of the current through the coils.

Referring now to FIG. 3, this drawing shows a schematic view of the flow and direction of an alternating current through the coils in one embodiment of coil arrangement 20.

Arrow 21 indicates the direction of inflow of current, while arrow 23 shows the direction of outflow. The current flows from the first coil 22 to second coil 24 so that the first coil 22 and the second coil 24 are out of phase with each other, given the orientation of the coils as shown. The current then flows from second coil 24 to third coil 26. For illustrative purposes only, the direction of flow in the third coil 26 is shown to be from an end proximate to first coil 22 to an end proximate to second coil 24.

Figure 3A:
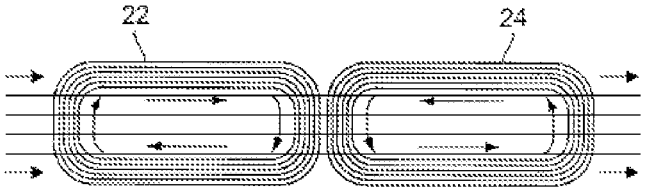
FIG. 3A shows an embodiment where the two coplanar coils have current flow in opposite directions, or out of phase with each other.
Figure 3B:
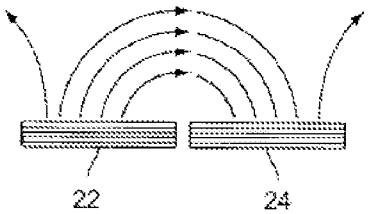
FIG. 3B shows the directional lines of the composite deactivating magnetic field generated by the two coil arrangement illustrated in FIG. 3A where the two coils operate out of phase with each other.

In some typical embodiments, the first coil 22 and the second coil 24 are arranged such that the flow of current causes the two coils to operate out of phase with each other. The resulting magnetic field is thereby limited to an area in the immediate vicinity of the coil arrangement. FIG. 3A shows a top view of such a coil arrangement, with the relative flow of current in the coplanar, serial, out of phase coils 22 and 24. The current then flows through the third coil 26 in the direction explained above. FIG. 3B is a side view of the coil arrangement, showing the directional lines of force of a magnetic field as generated by the coil arrangement when restricted to the two coplanar, out of phase coils 22 and 24. The magnetic field generated by coils 22 and 24 contributes to the final deactivating magnetic field that is generated after the current flows through the third coil 26 in the direction explained above.

Figure 4A:
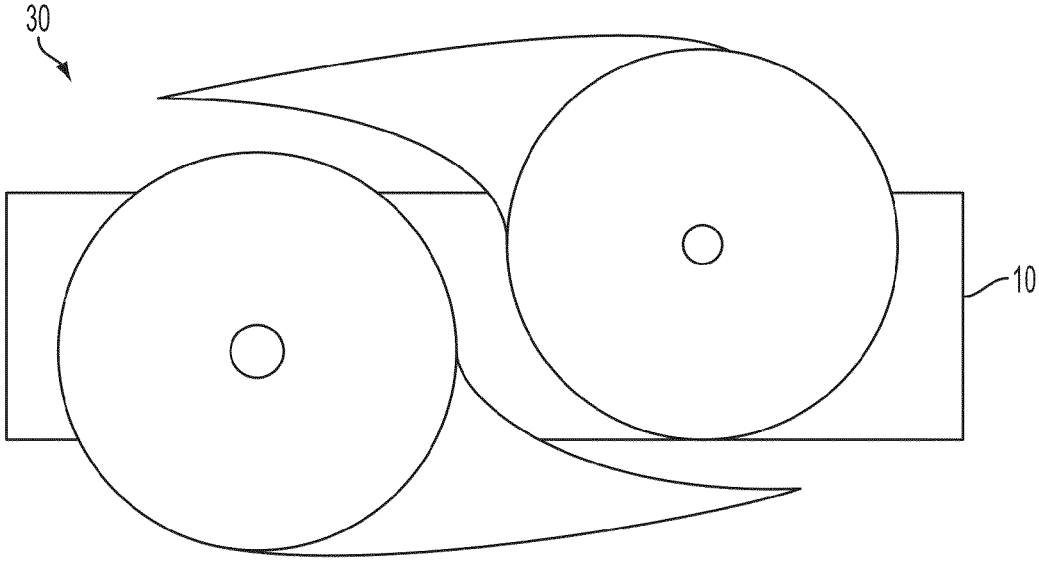
FIG. 4A is a schematic top view of the deactivating magnetic field generated by an embodiment of the deactivator.

FIG. 4A is a schematic top view of an approximation of the deactivating magnetic field 30 generated by an embodiment of the deactivator 10. Deactivator 10 in this embodiment comprises of a deactivating coil arrangement 20 and a detecting antenna 15 (as shown in FIG. 1B). Coil arrangement 20 generates a deactivation field, while detecting antenna 15 generates an interrogation field. The interrogation field acts as a detection system. Some embodiments of this invention may include one or more such detection systems. In such embodiments, the interrogation field interrogates the tag, and the tag responds with information about itself that the interrogation field can use to determine if the tag may be deactivated. If the tag is amenable to deactivation, the coils are energized, producing the deactivating field. Such detection systems are well known in the art. The deactivating magnetic field starts with alternating amplitude of a given magnitude. It then alternates and decreases in intensity, commonly known as "ringing down," or attenuating, to zero. A deactivating magnetic field having these characteristics will deactivate a magnetomechanical tag present in the field. Such a field may be generated by one or more coils. As will be described subsequently, this deactivating magnetic field pattern facilitates the deactivation of an EAS tag in any orientation.

Figure 4B:
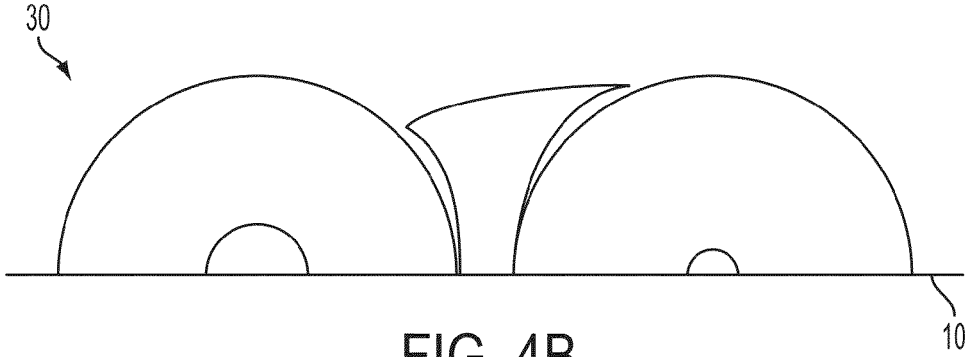
FIG. 4B is a schematic side view of the deactivating magnetic field generated by an embodiment of the deactivator.

FIG. 4B is a schematic side view of an approximation of the deactivating magnetic field 30 generated by an embodiment of the deactivator 10. Deactivator 10 in this embodiment comprises of a deactivating coil arrangement 20 and an antenna 15 (as described in FIG. 1B). Antenna 15 generates an interrogation field. When this field detects the presence of a tag, coil arrangement 20 is energized by the passage of current through it, generating a deactivating field. The deactivating magnetic field starts with alternating amplitude of a given magnitude. It then "rings down," or attenuates, to zero. A deactivating magnetic field having these characteristics will deactivate a magneto-mechanical tag present in the field. Such a field may be generated by one or more coils. As will be described subsequently, this deactivating magnetic field pattern facilitates the deactivation of an EAS tag in any orientation.

Figure 5A:
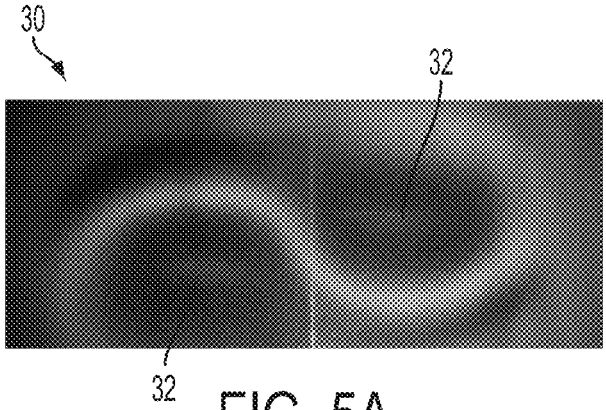
FIG. 5A is a top view showing the deactivating magnetic field pattern on the surface of an embodiment of the deactivator.
Figure 5B:
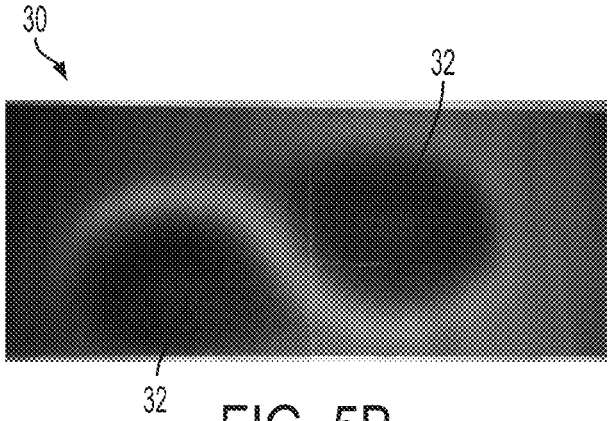
FIG. 5B is a top view showing the deactivating magnetic field pattern one inch above the surface of an embodiment of the deactivator.
Figure 5C:
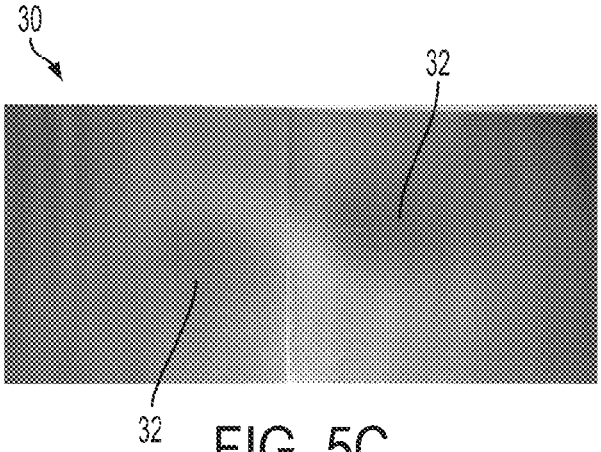
FIG. 5C is a top view showing the deactivating magnetic field pattern two inches above the surface of an embodiment of the deactivator.

FIGS. 5A-5E illustrate the results of a deactivating magnetic field testing. A magnetic field viewing film manufactured by Magne-Rite Corporation and available commercially was used for the tests. The film contains microcapsules of colloidal nickel particles suspended in oil. When placed in a magnetic field, the nickel particles align with the magnetic field flux lines. The film turns dark when the nickel particles align with the flux lines that are perpendicular to the viewing film. The film was used to map the deactivating magnetic field of an embodiment of the deactivator. The embodiment of the deactivator tested herein comprises of a deactivating coil arrangement 20 and an antenna 15 (as shown in FIG. 1B). FIG. 5A is a top view showing the deactivating magnetic field pattern 30 on the surface of an embodiment of the deactivator. FIG. 5B is a top view showing the deactivating magnetic field pattern 30 one inch above the surface of an embodiment of the deactivator. FIG. 5C is a top view showing the deactivating magnetic field pattern 30 two inches above the surface of an embodiment of the deactivator. In FIGS. 5A-5C, the dark area 32 indicates the presence of a deactivating magnetic field perpendicular to the film.

Figure 5D:
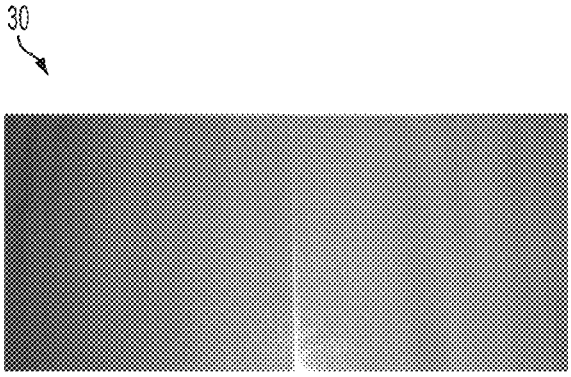
FIG. 5D is a top view showing the deactivating magnetic field pattern three inches above the surface of an embodiment of the deactivator.

FIG. 5D is a top view showing the deactivating magnetic field pattern 30 three inches above the surface of an embodiment of the deactivator. The film was no longer able to detect a deactivating magnetic field pattern at this range.

Figure 5E:
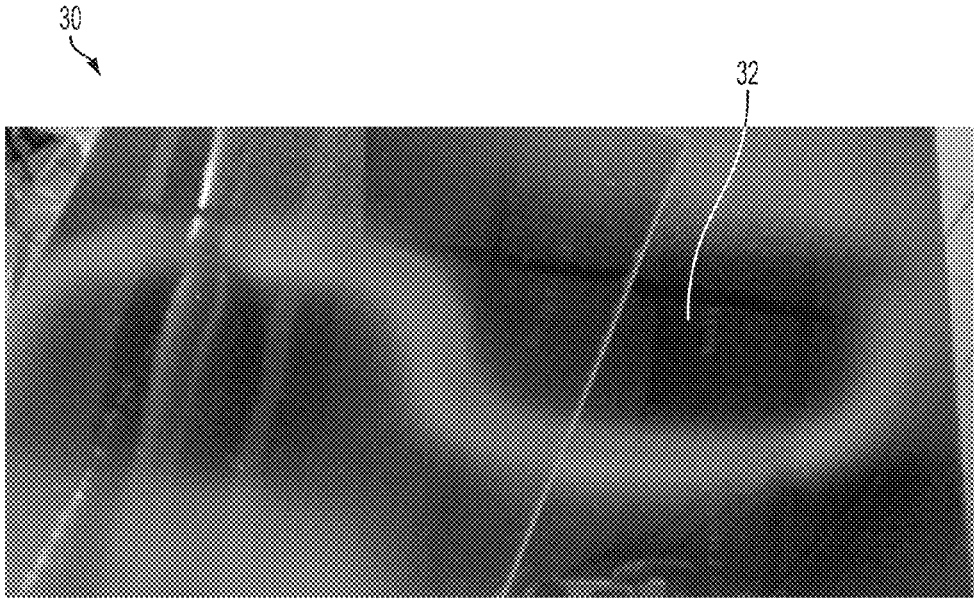
FIG. 5E is a top view showing the deactivating magnetic field pattern of an embodiment of the deactivator coil arrangement.

Additional testing was performed to determine the effects of detecting antenna 15 positioned above the deactivating coil arrangement 20 (as shown in FIG. 1B). The coil arrangement was removed from housing 14 (as shown in FIG. 1B). The deactivator coil arrangement field was determined by placing a Plexiglas grid one centimeter above the surface of the isolated coil arrangement. The deactivating coil arrangement field was turned on by scanning an EAS tag over the detecting antenna 15 and capturing the field in magnetic film as was done previously. FIG. 5E is a top view showing the deactivating magnetic field pattern obtained from the deactivating coil arrangement, without the interference of a detecting antenna. The dark area 32 indicates the presence of a magnetic field perpendicular to the film. The results indicate that the detecting antenna has a minor effect on the deactivator coil arrangement field 30 and negligible impact on the deactivator's ability to deactivate an EAS tag.

Figure 6:
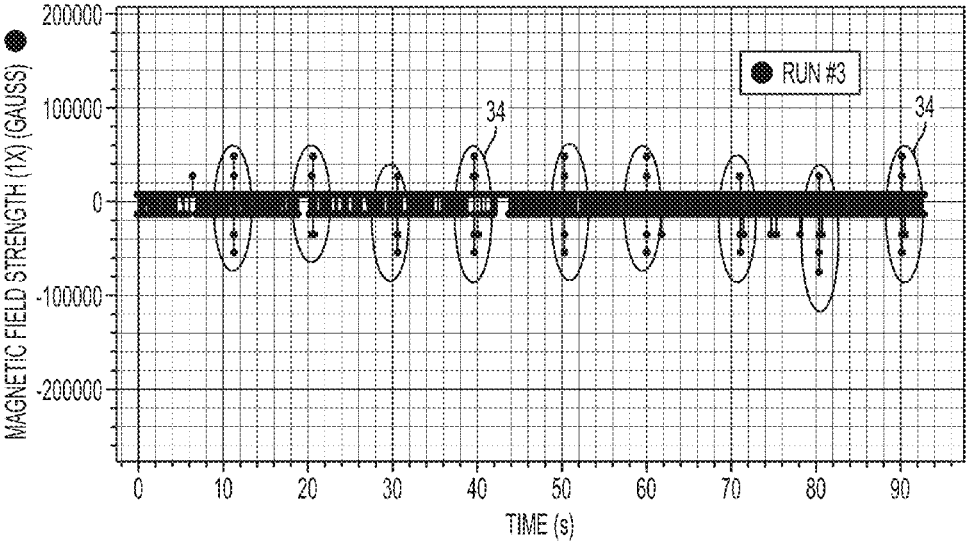
FIG. 6 is a graph illustrating the deactivating magnetic field measurements taken approximately ten seconds apart.

FIG. 6 is a graph illustrating the deactivating magnetic field measurements near the surface of an embodiment of the deactivator, taken approximately ten seconds apart. The magnitude of the deactivating magnetic field was measured in Gauss using a commercially available Pasco 750 data logging interface in combination with a Pasco Magnetic Field Sensor. Circles 34 represent each time the Tag was detected by the deactivator. The average deactivating magnetic field measurement was found to be $4.5\times10^4$ Gauss. The mean magnitude of the deactivating magnetic field was found to be $4.5\times10^4$ Gauss with a high of $5.0\times10^4$ Gauss and a low of $4.0\times10^4$ Gauss.

Figure 10:
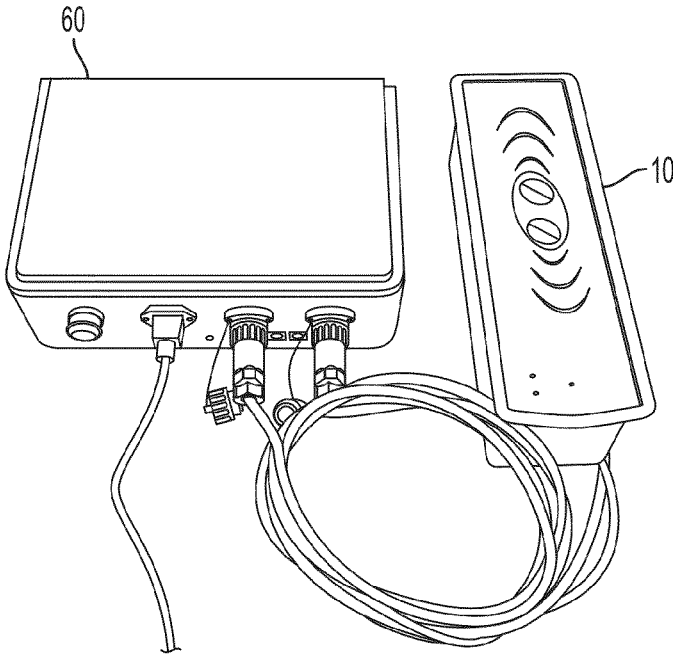
FIG. 10 is a top view of an embodiment of the deactivator electrically connected to an embodiment of a control unit.

Many prior art deactivating devices require the user to either push buttons or look for lights to see if an EAS tag is detected and/or deactivated. By contrast, at least one embodiment of the control unit includes a distinctive sound indicating presence and deactivation of the tag. FIG. 10 shows control unit 60 electrically connected to an embodiment of deactivator 10. Acoustic testing of this combination was conducted to determine its audio characteristics. A WinAudioMLS Audio Measurement Suite was used in conjunction with a Creative Labs SoundBlaster Extigy external sound card. The microphone used in testing was a Shure Model RS130. The microphone is a moving coil (i.e. dynamic) microphone with a cardioid (unidirectional) pick up polar pattern. All these devices are commercially available.

Figure 7A:
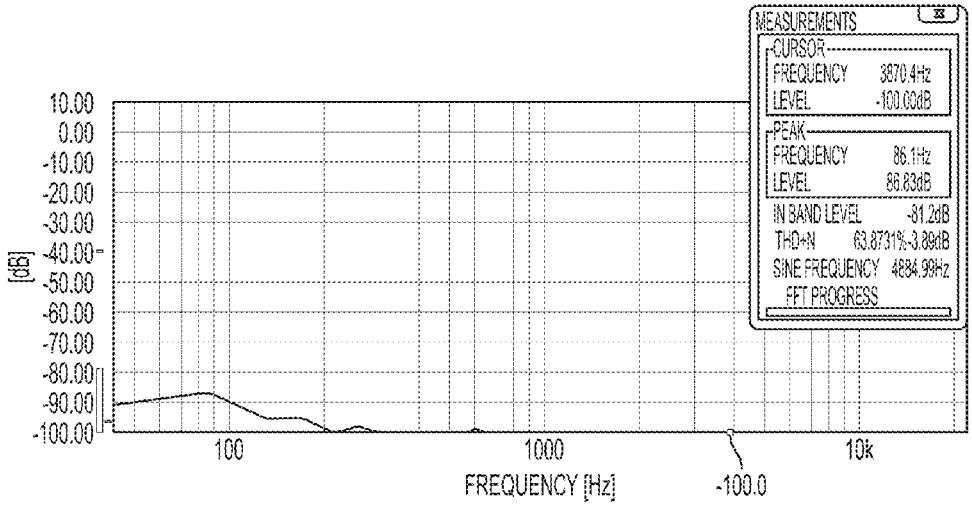
FIG. 7A is a graph illustrating the ambient noise spectrum of the testing area.

Referring now to FIG. 7A, which is a graph illustrating the ambient noise spectrum of the testing area. The ambient noise included low level noise in the 0 Hz to 200 Hz range.

Figure 7B:
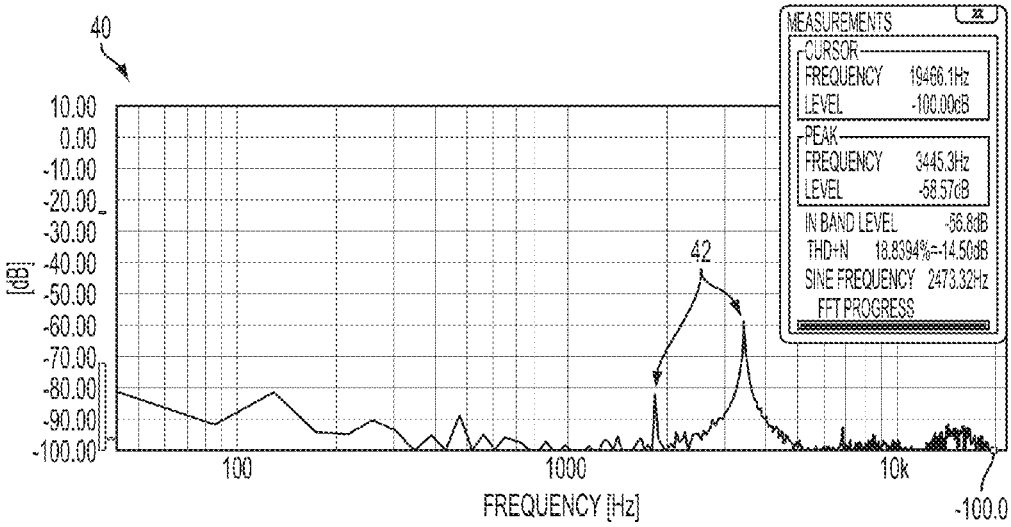
FIG. 7B is a graph illustrating the sound spectrum of an embodiment of the deactivator control unit when powered up.

Next, the control unit was turned on and allowed to warm up. Once warmed up a sound spectrum of the testing area was measured. Referring now to FIG. 7B, which is a graph illustrating the sound spectrum of the control unit and deactivator arrangement when the control unit is powered up. The arrangement shows a distinct acoustic signature 40 with peaks at 1900 Hz and 3400 Hz (+50 Hz), labeled as 42 in the figure.

Figure 7C:
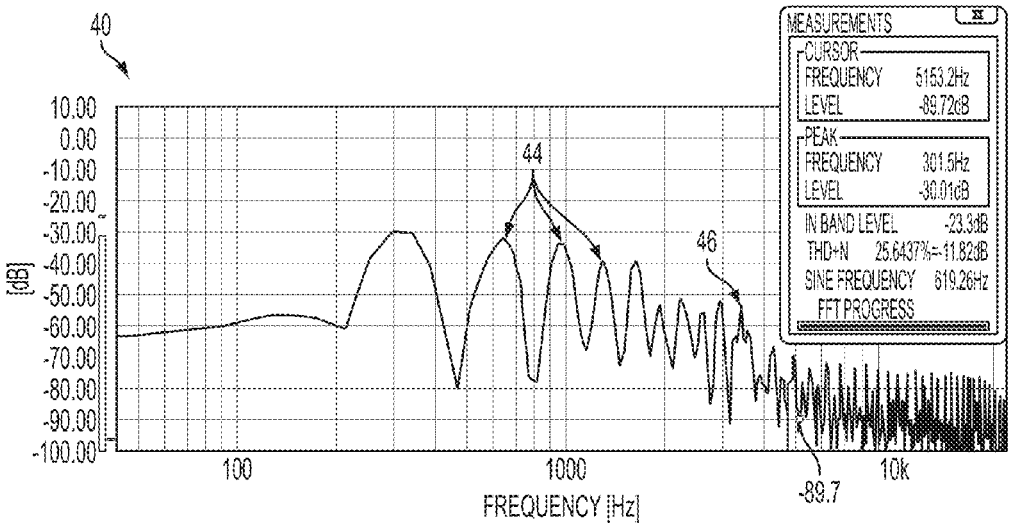
FIG. 7C is a graph illustrating the acoustic signature of an embodiment of the deactivator.

Next, the deactivator was actuated using an EAS tag and a characteristic spectrum was found for the deactivator. The deactivator's acoustic signature consists of a wide peak from 220 Hz to 480 Hz (+25 Hz). Referring now to FIG. 7C, which is a graph illustrating the sound spectrum 40 of the control unit and deactivator arrangement when the deactivator is actuated using an EAS tag. The figure illustrates the harmonics 44 and the control unit signature 46.

For many of the deactivators in the prior art, the deactivating magnetic field is such that a tag can only be swiped in a preferred direction to be deactivated. The strength of the deactivating magnetic field may require the tag to come in contact with the surface of the deactivating device. These disadvantages are removed in the present invention. The tag may be swiped in any orientation, and does not need to come in physical contact with the deactivating device.

Figure 8A:
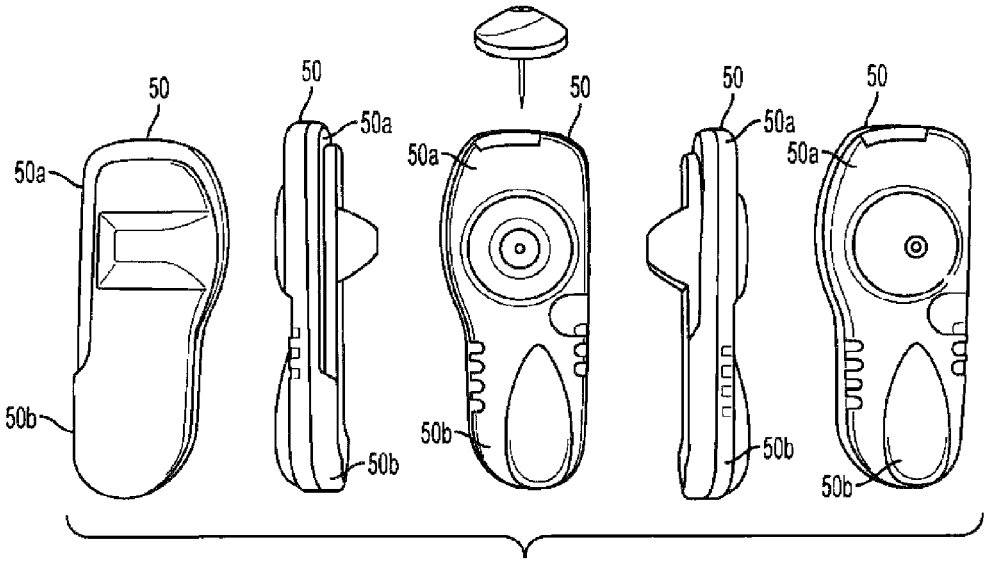
FIG. 8A (Prior Art)
FIG. 8A shows the interior of a typical embodiment of an EAS tag.
Figure 8B:
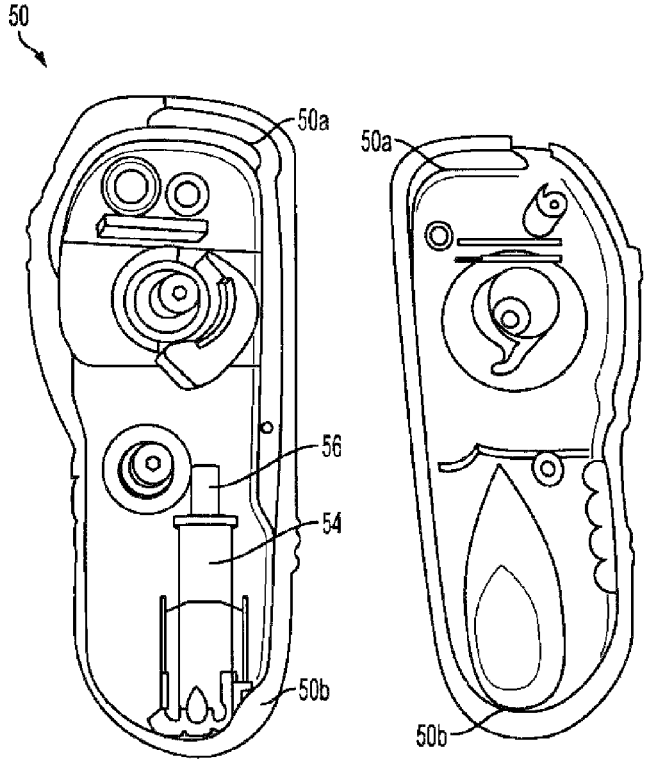
FIG. 8B (Prior Art)
FIG. 8B is a cross-sectional view of the embodiment of an EAS tag shown in FIG. 8A.

FIG. 8A shows the interior configuration of a typical embodiment of an EAS tag 50. A cross-sectional view of the same tag 50 is shown in FIG. 8B. A typical EAS tag includes a housing 50*b* which has a resonating cavity 50*c*. A resonator 56 and a magnetic biasing piece 54 are then placed inside the housing so as to fit within the resonating cavity 50*c*. The resonating cavity 50*c* is then closed with a cover 50*a*. Different embodiments of tag 50 may comprise additional resonators 56, or the relative positions of the resonators 56 and the biasing piece 54 may be interchanged. It is well-known in the art that different locations of the biasing piece 54 within the resonating cavity 50*c* have no effect on the detection performance of the label in a magnetic field.

In the present invention, the key to deactivating an EAS tag is the ability of a deactivator to detect its presence. As soon as the tag is detected by a detection system, the generation of the deactivating field is immediately triggered. As has been discussed with reference to FIGS. 5A-5D, the deactivating magnetic field generated by a coil arrangement of this invention is confined to an immediate vicinity of the deactivator. Testing has further confirmed that the deactivating magnetic field generated by the coil arrangement has no far-field effects. Additionally, as was discussed with reference to FIG. 5E, the presence of the detecting antenna has a negligible effect on the shape or intensity of the deactivating magnetic field. Finally, as was discussed with reference to FIG. 6, testing shows that the mean magnitude of the deactivating magnetic field is $4.5\times10^4$ Gauss with a high of $5.0\times10^4$ Gauss and a low of $4.0\times10^4$ Gauss. A field having these characteristics is sufficient to deactivate an EAS tag in any orientation. Testing was conducted to determine how an embodiment of the deactivator is activated based on the orientation of an EAS tag. Moreover, the deactivator need not come in physical contact with a tag being deactivated. Testing was conducted iteratively for every 10° through 360°. The tag positions included perpendicular, 45° and parallel to the deactivator. The tag movement directions tested for each position included longitudinal, latitudinal and directly above the deactivator. Therefore, the novel coil arrangement of this invention generates a deactivating field of such shape and intensity that deactivation of the tag is almost instantaneously achieved, especially since the tag may be detected and deactivated in any orientation.

Referring now to FIGS. 9A-9I, an embodiment of deactivator 10 is shown. To control the angle of orientation, the EAS tag 50 is shown attached to an object 58, which is then shown attached to a 360° protractor 52. As is illustrated, the testing resulted in the activation of deactivator 10 for all orientations of EAS tag 50.

Figure 9B:
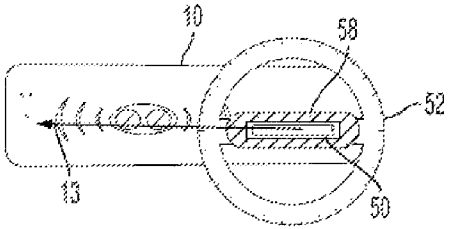
FIG. 9B is a top view of an EAS tag being deactivated along the longitudinal direction, where the tag is parallel to the surface of the deactivator.
Figure 9D:
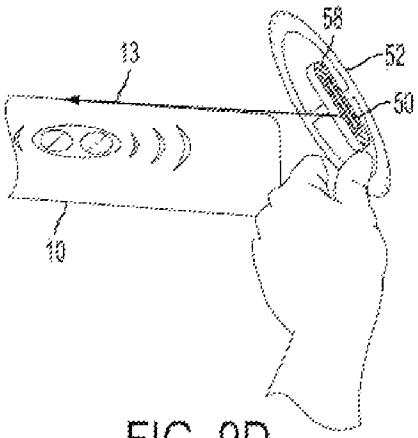
FIG. 9D is a top view of an EAS tag being deactivated along the longitudinal direction, where the tag is at an angle of 45° to the surface of the deactivator.
Figure 9A:
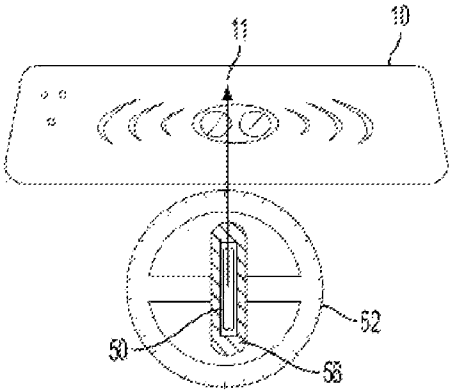
FIG. 9A is a top view of an EAS tag being deactivated along the latitudinal direction, where the tag is parallel to the surface of the deactivator.

FIG. 9A is a top view of an EAS tag 50 being deactivated along the latitudinal direction 11, where the tag 50 is parallel to the surface of the deactivator 10.

FIG. 9B is a top view of an EAS tag 50 being deactivated along the longitudinal direction 13, where the tag 50 is parallel to the surface of the deactivator 10.

Figure 9C:
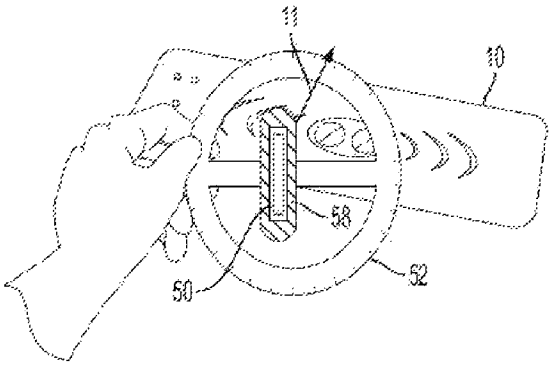
FIG. 9C is a top view of an EAS tag being deactivated along the latitudinal direction, where the tag is at an angle of 45° to the surface of the deactivator.

FIG. 9C is a top view of an EAS tag 50 being deactivated along the latitudinal direction 11, where the tag 50 is at an angle of 45° to the surface of deactivator 10.

FIG. 9D is a top view of an EAS tag 50 being deactivated along the longitudinal direction 13, where the tag 50 is at an angle of 45° to the surface of the deactivator 10.

Figure 9E:
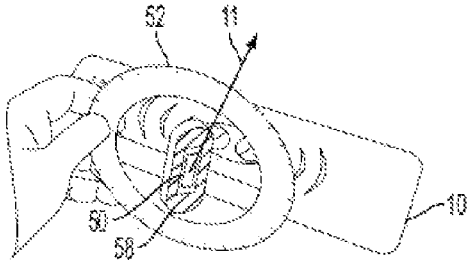
FIG. 9E is a top view of an EAS tag being deactivated along the latitudinal direction, where the tag is perpendicular to the surface of the deactivator.

FIG. 9E is a top view of an EAS tag 50 being deactivated along the latitudinal direction 11, where the tag 50 is perpendicular to the surface of the deactivator 10.

Figure 9F:
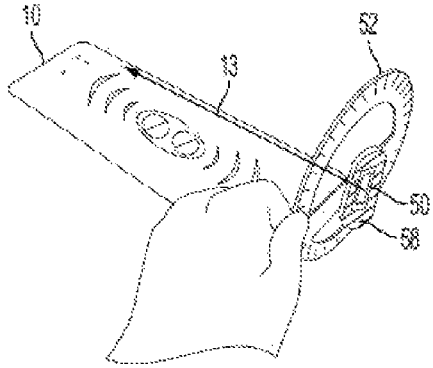
FIG. 9F is a top view of an EAS tag being deactivated along the longitudinal direction, where the tag is perpendicular to the surface of the deactivator.

FIG. 9F is a top view of an EAS tag 50 being deactivated along the longitudinal direction 13, where the tag 50 is perpendicular to the surface of the deactivator 10.

Figure 9G:
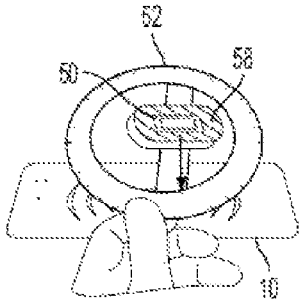
FIG. 9G is a top view of an EAS tag being deactivated along the longitudinal direction, where the tag is parallel to the surface of the deactivator.

FIG. 9G is a top view of an EAS tag 50 being deactivated along the latitudinal direction 13, where the tag 50 is parallel to the surface of deactivator 10.

Figure 9H:
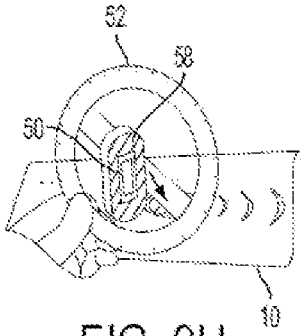
FIG. 9H is a top view of an EAS tag being deactivated along a direction that is at an angle of 45° with respect the longitudinal direction of the deactivator, where the tag is perpendicular to the surface of the deactivator.

FIG. 9H is a top view of an EAS tag 50 being deactivated along a direction that is at an angle of 45° with respect the longitudinal direction 13 of the deactivator, where the tag 50 is perpendicular to the surface of deactivator 10.

Figure 9I:
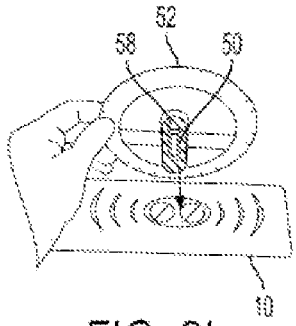
FIG. 9I is a top view of an EAS tag being deactivated along the latitudinal direction, where the tag is perpendicular to the surface of the deactivator.

FIG. 9I is a top view of a EAS tag 50 being deactivated along the latitudinal direction 11, where the tag 50 is perpendicular to the surface of deactivator 10.

FIG. 10 illustrates an embodiment of the deactivating device 10 electrically connected to a control box 60. The control box is capable of altering the current flow to the coils to adjust the shape and strength of the deactivating magnetic field desired to be generated. The control unit may also vary the timing of the activation of the coil sets depending on the application. US Patent Application No. 2010/0052910 by Yang discloses one such control box. The teachings in the specification for this patent application are incorporated herein by reference.

Figure 11:
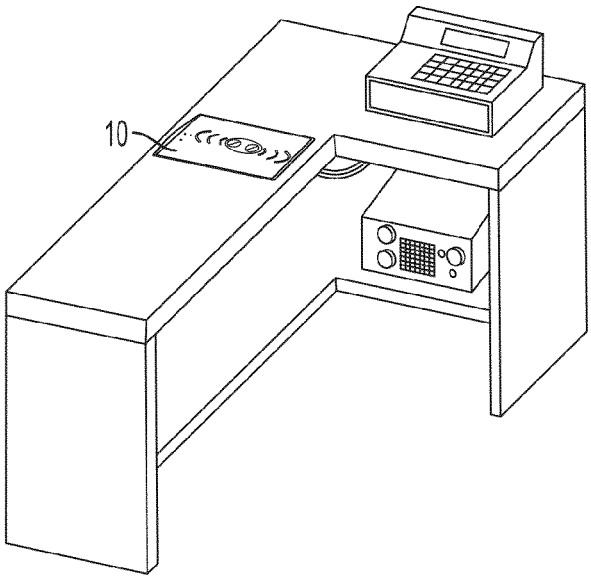
FIG. 11 shows an embodiment of the deactivator located at a point of sale counter.

FIG. 11 shows how the deactivating device 10 may be flush mounted at a POS. Typically, such a device is placed at a checkout counter of a retail store where a store employee will be positioned to check out goods for a customer. For most of the deactivators in the prior art, the deactivating magnetic field is such that the tags can only be swiped in a preferred direction. The strength of the deactivating magnetic field may require the tags to come in contact with the surface of the deactivating device. Often, the far-field effects of the deactivating magnetic field interfere with other functions that are performed at the counter. These disadvantages are removed in the present invention. The tag may be swiped in any orientation, and does not need to come in physical contact with the deactivating device. At the same time, the composite deactivating magnetic field is intense over a certain limited area, and its far-field effects are not present. The deactivation system may be turned off completely such as when no one will be in the area to check out goods and deactivate tags on merchandise, thus preventing unauthorized use of the device. Moreover, the device is easy to move. It is flush mounted, which means that it conserves space, thus leaving more area and flexibility in the area where tags need to be deactivated. Given the large volume of tags that may need to be deactivated over a considerably short interval of time, these improvements over the prior art are very significant.

While the coils in the device have been typically shown as round, it should be understood that their shapes could take many forms. Depending on the shape of the area being covered and other factors, the coils could be square, triangular, etc. The deactivating magnetic field would still be capable of deactivating tags.

While many novel features have been described above, the invention is not limited to these physical embodiments. It is described and illustrated with particularity so that that those skilled in the art may understand all other embodiments that may arise due to modifications, changes in the placement of the relative components, omissions and substitutions of the embodiments described herein, that are still nonetheless within the scope of this invention. Therefore, the scope of the invention is intended to be limited solely by the scope of the appended claims.

I claim:

1. A deactivator for use in deactivating an electronic article surveillance ("EAS") marker, comprising:
- a housing; and
- an electrical coil arrangement;
  - said housing having an internal structure holding said electrical coil arrangement;
  - said coil arrangement having first, second and third electrical coils formed of
    - multiple windings of a wire;
    - wherein said first and second electrical coils are essentially coplanar and arranged side-by-side in a first plane;
    - wherein said third electrical coil lies in a second plane intersecting said first plane, the common line of said first and second plane passing through the centers of said first and second coils, said third coil circumscribing said first and second coils;
    - wherein current flowing through said first, second and third electrical coils generates a composite deactivating magnetic field that deactivates an electronic article surveillance marker.

2. The deactivator of claim 1, wherein:
- said first and second planes are perpendicular.

3. The deactivator of claim 1, wherein:
- said housing has at least one aperture on its outer surface to emit an audible sound.

4. The deactivator of claim 1, wherein:
- said housing has at least one aperture on its outer surface for an LED.

5. The deactivator of claim 1, wherein:
- said first and second electrical coils are arranged such that said current flowing through said wire causes said first and second electrical coils to operate out of phase with each other.

6. The deactivator of claim 1, wherein:
- said first, second and third electrical coils are electrically connected in series with each other.

7. The deactivator of claim 1, wherein:
- the magnitude of said composite deactivating magnetic field may be altered.

8. The deactivator of claim 7, wherein:
- the magnitude of said composite deactivating magnetic field may be altered as a result of changing the amount of electrical current in one or more of said electrical coils.

9. The deactivator of claim 1, wherein:
- the number of windings in said first electrical coil and said second electrical coil are essentially the same.

10. The deactivator of claim 1, wherein:
- said deactivator need not come in physical contact with said marker being deactivated.

11. The deactivator of claim 1, further comprising:
- a supply of electrical current to said first, second and third coils.

12. The deactivator of claim 11, further comprising:
- a detecting system for detecting when said marker is in proximity to said deactivator;
- wherein said supply of electrical current cycles said first, second and third coils to deactivate said marker detected in proximity to said deactivator.

13. The deactivator of claim 12, wherein:
- the detection of a marker is the indication that it is not deactivated.

14. The deactivator of claim 12, further comprising:
- a system that emits a distinctive sound indicating detection and deactivation of said marker.

15. The deactivator of claim 1, further comprising:
- a system that emits a distinctive sound indicating deactivation of said marker.

16. A deactivating magnetic field to deactivate an electronic article surveillance marker, wherein:
- said deactivating field is generated by an electrical coil arrangement;
  - said coil arrangement having first, second and third electrical coils formed of
    - multiple windings of a wire;
    - wherein said first and second electrical coils are essentially coplanar and arranged side-by-side in a first plane;
    - wherein said third electrical coil lies in a second plane intersecting said first plane, the common line of said first and second plane passing through the centers of said first and second coils, said third coil circumscribing said first and second coils;
  - wherein current flowing through said first, second and third electrical coils generates said deactivating field.

17. The deactivating field of claim 16, wherein:
- the magnitude of said field may be altered.

18. The deactivating field of claim 17, wherein:
- said field has a magnitude of a high of $5.0\times10^4$ Gauss and a low of $4.0\times10^4$ Gauss.

19. A method of operating and controlling a deactivator for use in deactivating an electronic article surveillance marker, the method comprising the steps of:
- said deactivator generating an interrogation magnetic field;
- said deactivator monitoring for a response from an EAS marker;
- said deactivator generating a deactivating magnetic field when an EAS marker is detected;
- said deactivator repeating the previous steps until an EAS marker is not detected;
- said deactivating field being generated by an electrical coil arrangement;
  - said coil arrangement having first, second and third electrical coils formed of
    - multiple windings of a wire;
    - wherein said first and second electrical coils are arranged essentially coplanar and arranged side-by-side in a first plane;
    - wherein said third electrical coil lies in second plane intersecting said first plane, the common line of said first and second plane passing through the centers of said first and second coils, said third coil circumscribing said first and second coils;

wherein current flowing through said first, second and third electrical coils generates said deactivating magnetic field.

20. The method of claim 19, further comprising:

If the EAS marker is deactivated, providing a distinctive audio cue to an operator.

* * * * *